US008001732B2

(12) United States Patent
Regan

(10) Patent No.: US 8,001,732 B2
(45) Date of Patent: Aug. 23, 2011

(54) HYPERSHELTER

(76) Inventor: Michael Regan, Port Hadlock, WA (US)

( * ) Notice: Subject to any disclaimer, the term of this patent is extended or adjusted under 35 U.S.C. 154(b) by 229 days.

(21) Appl. No.: 12/229,330

(22) Filed: Aug. 22, 2008

(65) Prior Publication Data

US 2009/0071081 A1 Mar. 19, 2009

Related U.S. Application Data

(63) Continuation-in-part of application No. 11/784,584, filed on Apr. 9, 2007.

(51) Int. Cl.
*E04B 7/10* (2006.01)

(52) U.S. Cl. ..... 52/80.2; 52/80.1; 52/82; 52/90.1; 52/81.1

(58) Field of Classification Search ..... 52/80.2, 52/82, 90.1, 747.1, 81.1, 81.2, 653.1, 745.06
See application file for complete search history.

(56) References Cited

U.S. PATENT DOCUMENTS 3,016,115 A * 1/1962 Harrison et al. ..... 52/18
3,049,785 A * 8/1962 Chiado et al. ..... 249/189
3,060,949 A * 10/1962 Moss ..... 135/87
3,092,932 A * 6/1963 Wilson ..... 52/80.2
3,139,958 A * 7/1964 De Witt ..... 52/70
3,204,372 A * 9/1965 Richter ..... 52/80.1
3,252,469 A * 5/1966 Peake ..... 135/25.31
3,846,953 A * 11/1974 Hodess ..... 52/745.08
5,000,211 A * 3/1991 Speare et al. ..... 135/97

* cited by examiner

*Primary Examiner* — Brian E Glessner
*Assistant Examiner* — Patrick Maestri

(57) ABSTRACT

The instant invention is a method for achieving a-planar framing configurations which enable the construction of hyperbolic paraboloid surfaces, a multiplicity of which join to create roof structures and enclosures.

In particular, the shaping and erecting of connected a-planar quadrilateral frames to create under-framing which can be completed by a simple in-framing, and covered with sheeting material resulting in a new method of constructing enclosures with hyperbolic paraboloid faces without the use of highly trained crews, or the need for elaborate pre-forms or specialized connecting or covering elements.

The additional methods of assembly and erection of a hypershelter described herein make possible even greater strength-to-weight ratios and more efficient construction procedures than was possible at the time of the original application. The pre-stressed effects of the twisted framing members, and the progressively rotated orientations of the faces are strength enhancements; and the assembly of whole faces before erection makes possible a great deal of savings in the construction process. As a result of these improvements, it also makes it easier to create various embodiments of hypershelters, here called "domular" and "multi", that were not noted previously.

1 Claim, 12 Drawing Sheets

HYPERSHELTER

CONTINUATION IN PART

This application is a continuation in part of patent application Ser. No. 11/784,584 filed on Apr. 9, 2007.

FIELD OF INVENTION

The present invention relates generally to improved structural configurations and methods for assembling structures with hyperbolic paraboloid faces.

BACKGROUND OF THE INVENTION ('584)

There have long been efforts to construct buildings and tents that span a floor area without the need for intrusive interior supports. The typical approach is to assemble a framework of rigid linear materials, which is then covered with a surfacing material, or skin.

Stresses must be carried by a combination of tension and compression members, organized into a system that carries the distributed loads of the skin, and focuses them onto several support points on the ground. The total of all compression forces equals the total of all tensile forces. When seen together, the pathways of these forces form triangular patterns within the whole structure, and these patterns are best managed by designing triangles directly into the framework.

From the simplest to more complex space-enclosing shapes:

(1) The traditional pup-tent, (a prism-shape, or, alternatively, a pyramid shape), had to be anchored to the ground, in part to make more usable interior space by pulling the sagging skin outward. This puts additional tension on the skin, and compression on the poles. It also takes up space on the exterior, making it difficult to walk around the tent without tripping on these tension lines. Other prism shapes, such as the "A-frame" buildings, also have problems, one of the biggest being their large surface areas, through which heat is lost.

(2) Another traditional solution has been to use a cubical configuration, in which the walls are vertical, and are made rigid by the application of sheathing materials or diagonals inserted into the framing. The roof is typically constructed by means of trussing, resulting in either a peaked or a flat roof. A big drawback is that this type of building requires more lumber per square foot of usable space than either a geodesic dome, or a "hypershelter". A lot of material is used in the trusses, and the over-all building is thus top-heavy. A volume of the covered space is unusable, being inside the jungle of triangles in the attic. The instant invention contains a greater usable volume for a given surface area than any cubical structure, and is therefore more economical both in the expenditure of materials, and in the amount of labor required.

(3) A solution recently employed has been to use a dome shape with the outward forces being supplied by very long tent-poles, held under constant stress by being bent. This is very workable on small scales, and yields good strength-to-weight ratios as well as high volume-to-surface-area ratios because of the near-hemispherical shape. However, such stressed arches are not effective when rigidity is desired, and it is difficult to apply to larger structures for two reasons: (A): Assembling long, continuous, stressed framing members becomes more unwieldy as size increases, and (B): Strength-to-weight ratios decrease as overall size increases, because weight goes up on a function of the cube of the increase, whereas strength only increases on a squaring function. This makes it difficult to find the appropriate material of sufficient resiliency to support its own weight when used as a stressed arch.

(4) The use of panel constructions which can be assembled into building structures of various sizes, shapes, and types. Systems for attaching the panels to each other; and building structures of panel-type construction, are well known in the art. For example, see U.S. Pat. No. 3,945,160 to Grosser.

(5) Also known in the art is the assembling of panel constructions into geodesic dome structures. For example, see U.S. Pat. No. 4,160,345 to Nalick. The connectors for forming the structures by joining panel construction together is also well known in the art. For example see U.S. Pat. No. 6,173,547 to Lipson. When constructing a geodesic dome type structure such as in U.S. Pat. No. 2,682,235 to Fuller, or U.S. Pat. No. 6,295,785 to Herrman, a bottom edge is created that is typically raised over a substantially cylindrical portion into which doors and windows are fitted. As with these references and with U.S. Pat. No. 5,305,564 to Fahey, cells are typically arranged in circular rows. Each cell has edges, and as with triangles, they require special connectors and edge materials, which increase the cost of construction.

The geodesic dome, (U.S. Pat. No. 2,682,235 to Fuller,) has many advantages which are achieved by means of straight-member, all-triangle framing where all stress problems are dealt with directly, the forces being sent predictably along straight struts. The weight is distributed downward and outward along these, and rests on the base at many points. The curved shape, and the orientation of the struts means that most struts act in compression to carry weight loads, though any strut can also come under tension, depending on specific forces acting on the whole structure.

On a large scale, the dome is assembled from a multiplicity of smaller pieces, and is usually covered with some rigid surfacing material, which acts, at shared edges, to reinforce the struts.

While not containing quite the volume per unit surface area of the geodesic dome, the instant invention, hypershelter has the above advantages of the geodesic dome, but avoids the following disadvantages:

Problems arising in construction of a geodesic dome:

1) The triangles, though mass-producible in repeating patterns in a geodesic dome, create challenges in cutting covering materials, because these are commonly produced in rectangular forms, and require cutting to specifications which inevitably entail waste of unusable scraps.

2) The erection of the framework of a geodesic dome usually involves assembling the struts into successive courses of triangles, which, on large scales, requires the use of a crane and/or scaffolding. These initial courses are very unstable until the succeeding courses are assembled on them.

3) There are a large number of edges between triangles in a geodesic dome, and these constitute a very great length, simply because the triangle is the shape with the most perimeter to surface area. Although the planes join at obtuse angles so the ridges are less sharp, these edge lengths constitute a serious problem for the geodesic dome. The instant invention requires a minimum of such ridges, or edges. An N-way hypershelter has only N ridges.

4) Associated with the above is the difficulty of creating openings such as windows and doors, which must either be restricted within given triangles, or require the radical shape and re-engineering required in the creation of dormers or other protrusions. Openings such as skylights made in roof panels also engender the care and expense required in waterproofing.

5) Another drawback of the geodesic dome structures is that highly sophisticated crews and specialized connecting hardware must be employed for construction.

The hypershelter configuration has the capability of spanning large areas without the requirement that there be any internal supports. In this regard, it resembles a dome structure, such as the geodesic, which can be varied to span larger areas per height by taking a shallower slice of the sphere. In the hypershelter, a similar variation can be achieved by using shorter leg members, and varying the height of the apex. But, the hypershelter spans these large areas while allowing large openings at the periphery for the ingress and egress of goods and people. These openings are triangular, making them rigid by design, and can be varied down to lower profiles while remaining vertical. Additional vertical supports can then be added without interfering with the over-all utility of the structure. The shape of the over-all structure sweeps out to these openings along the smooth curvature of the hyperbolic paraboloid; faces, so that there is no need for sudden protrusions and sharp-edged valleys, as in the typical dormer constructions.

The main spanning members in the roof are at the ridges, so each is at the edge of two convergent planes. The planes are leaning in compression against each other. Thus, their own weight is being supported by the structural members of these planes, and distributed downward across their faces. The great spanning capacity is thus accomplished without the need for the multiplicity of faces, edges, struts, or connectors occurring in the geodesic dome. Related to these benefits is that the hypershelter can be covered in large, continuous areas, rather than piecemeal.

Other structures, most notably roofs, have been made using hyperbolic paraboloids for the beauty and great strength afforded by such. See H. H. Charles, U.S. Pat. No. 3,186,128. Also, Eugene Pryor, U.S. Pat. No. 3,757,478 and Paul T Hodess, U.S. Pat. No. 3,846,953, beams hinged for erection of hyperbolic paraboloid roofs; and Harry L Guzelimian, U.S. Pat. No. 3,280,518, Curved roof support system; and Daniel F. Tully U.S. Pat. No. 4,137,679, Inverted, doubly-curved umbrella hyperbolic paraboloid shells with structurally integrated upper. Diaphragm; and Ray A Woods U.S. Pat. No. 5,020,287 Structural Building Components; and Solomon Kirschen U.S. Pat. No. 4,320,603 Roof construction; and Arthur T Brown, U.S. Pat. No. 3,200,026 Method of producing a Shell Roof structure; and Peter E. Ellen, U.S. Pat. No. 5,069,008 Building panel.

But, in those constructions, the builders have resorted to the use of expensive pre-formed panels to achieve the compound curvature required in a hyperbolic paraboloid shape, or other elaborate preforms, or have designed complex connectors. The instant invention achieves the hyperbolic paraboloid shape by the use of commonly available framing materials, applied successively to an under-framing, and covered with strips of roofing material (such as sheet metal, plywood, thatching, etc) successively bent into place while being applied. In the preferred hypershelter, the completed structure efficiently encloses volumes, as well as providing roofing for covering areas, because the lower portions of the hyperbolic paraboloid faces act partly as walls. Problems in the erection of the frameworks are also overcome in the instant invention by the pre-assembly on the ground, and wholesale, umbrella-like deployment of the framework as described herein.

It would therefore be beneficial to have a structural configuration and method for erecting same that encloses a large volume per unit surface area, and minimizes the need for edge connectors, specialized strut connectors, or custom dormers, and provides for openings that can be used as windows or doors, and is capable of being constructed by average unskilled or semi-skilled crews. This is possible with the instant invention.

BACKGROUND

Much of the general background having been discussed in the patent application, '584, a few words on the background of the instant Continuation in Part follow:

While it is quick and effective to be able to erect frameworks in one umbrella-like step, it may be even easier and less costly to be able to erect whole faces, or whole structures, all at once. This will also reduce the necessity, and thus the dangers, of climbing on ladders or scaffolding to attach roofing materials.

There are presented some structural improvements, such as the rotation of directionality of faces, and the assembly without the use of inframing that reduce the weight of the required materials, and therefore reduce erection time and cost. These new methods and structural improvements also open up new variations in the use of hyperbolic paraboloid faces, especially to create larger structures, and ones which cover more floor area per their height.

All of these methods, structural improvements and additional configurations are described and presented in the instant continuation, with the addition of the necessary drawings and claims.

SUMMARY OF THE INVENTION ('584)

The hypershelter is a structural configuration and building method for assembling structures of widely various scales for such uses as playground equipment, hanging ornaments, and for shelters, such as tents, barns, commercial buildings, residences, stadiums, airplane hangars, etc, by the construction of three or more joined hyperbolic paraboloid elements created from commonly available materials.

The instant invention may be used as a structure which collects the distributed load of the roof, focusing it continuously downward to the three or more points of support at the base, the ground, a suitable foundation or set of support walls, so it requires no intrusive interior supports, and methods are provided herein for creating these structures using commonly available building materials.

The curvature of each face is achieved by the succession of progressively oriented, near-parallel, straight framing members together with successively applied strips of covering materials. The covering materials are joined to the framing, and to each other, making the entire structure a continuous whole. To accommodate the gradual curvature only requires a slight twisting of each sheet of the covering materials as they are applied to the framing. The hyperbolic paraboloid curvature thus achieved allows the covering materials to play a role in supporting their own weight.

A tension member ("tension restraining member"), attached at the peaks of the triangular openings, and running circumferentially around the structure stabilizes the framework during construction, and restrains the outward thrust imposed by weight such as a snow-load resting on the roof.

Each face has a compound curvature, arching inward vertically, and curving outward horizontally (a hyperbolic paraboloid) in the preferred embodiment. Within the framing, a series of optional radial braces connecting each pair of successive members from the base to the peak may be attached, following a locus of lines forming an arch, capable of carrying great loading forces to the ground. Additional such arches can be formed, each running substantially parallel to the primary ones. The tension restraining member also exerts an upward force on the framing in the hyperbolic paraboloid spans, because of its substantially inward curvature between peaks. For some uses, semi-liquid materials such as cement, foam, or fiberglass with resin, which are designed to harden when cured, may be applied onto the hyperbolic paraboloid surfaces.

Optional vertical support posts may be added around the periphery, attaching to leg members. Besides carrying weight, these will provide framing to which doors, windows, and surfacing materials may be attached, completing the enclosure.

The subject matter of the present invention is particularly pointed out and distinctly claimed in the concluding portion of the specification. However, both the organization and method of operation, together with further advantages and objects thereof, may best be understood by reference to the following description taken in connection with accompanying drawings wherein like reference characters refer to like elements.

SUMMARY OF THE INVENTION

Hypershelters composed of frameworks with roof and interior sheeting can be constructed and erected in stages, as in patent '584, where a unique way of raising the frameworks is presented. However, many of these stages may be combined, either by the use of sheeting with slidable edge connections, or by completing whole faces before erection. Also, structures can be made to have sufficient strength to support the required loads without excess self-weight, by rotating faces, twisting framing members, and in certain cases, by eliminating the use of inframing. With these improvements, it becomes possible to erect the structures wholesale, using fewer major steps.

The subject matter of the instant invention is particularly pointed out and distinctly claimed in the concluding portion of the specification. However, both the organization and method of operation, together with further advantages and objects thereof, may best be understood by reference to the following description taken in connection with accompanying drawings wherein like reference characters refer to like elements.

SPECIFICATIONS ('584)

Hypershelters have three or more hyperbolic paraboloid faces. A hypershelter of N faces is generally N-way symmetrical, with N being greater than 3. For each hypershelter symmetry, there are innumerable variations. The preferred embodiment, a variation in symmetry N=4, has equal leg and ridge members and is chosen for its ease of construction, and for its high volume-to-surface-area ratio.

Figure 1:
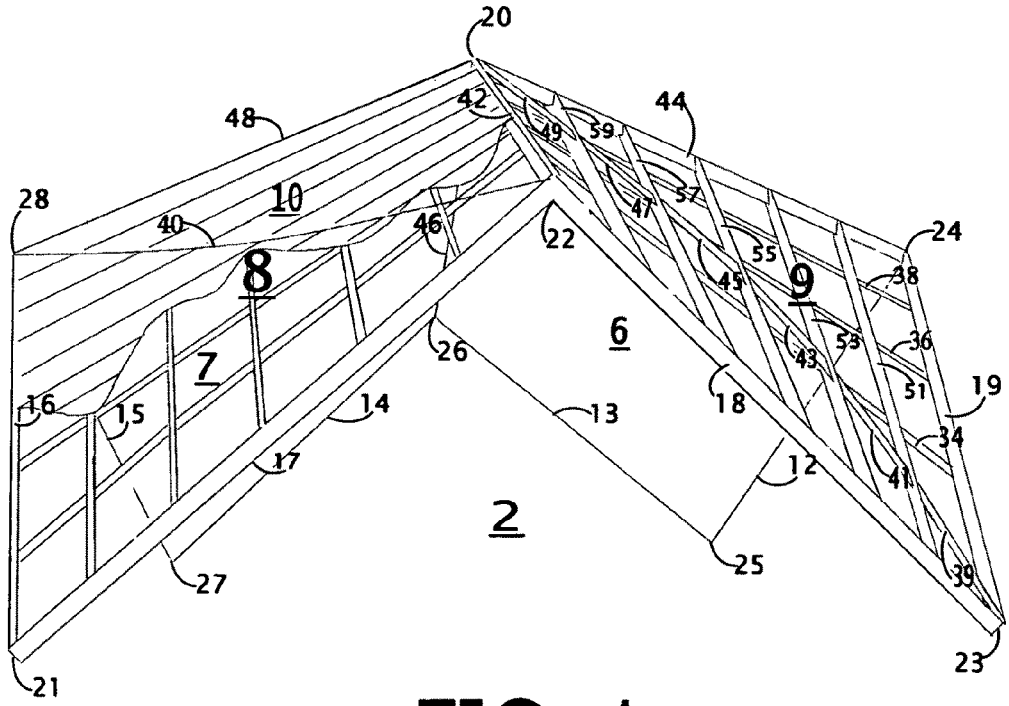
FIG. 1 is an isometric view of the preferred embodiment.

Now referring to FIG. 1 the preferred embodiment, 4, is a 4-way symmetrical structure. There are four joined sections forming a 4-way embodiment. The sections consist of framing covered to form the 4 hyperbolic paraboloid faces, 6,7,8, 9. On the periphery of each face, for example 9, an a-planar quadrilateral frame is formed by two leg members 18,19 and two ridge members 42,44. A multiplicity of in-framing members 34,36,38, and 51,53,55,57,59 are constructed across said quadrilateral frame, defining the shape for the hyperbolic paraboloid face.

Figure 2:
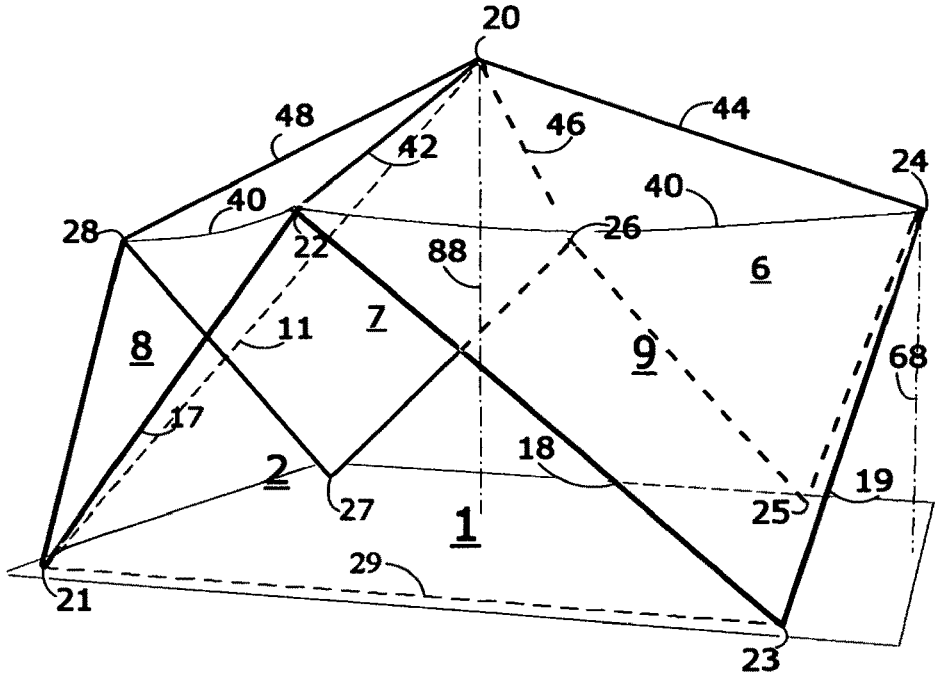
FIG. 2 is a side view of the under-framing of a 4 way embodiment of the instant invention.

Now referring to FIG. 2 triangular openings 2 are formed between two leg members 17,18, and the line, 29, between two foot joints 21,23, which lie at the base 1; having one peak joint 22 at the top. The base may be the ground, or anchor points on the ground, a floor, or footers, etc. In a model of a hypershelter, this base is a flat plane. All framing members shown in FIG. 2, taken together, comprise the underframing, 12,13,14,15,16,17,18,19, and 42,44,46,48, respectively, the leg and ridge members. Also shown are: the tension restraining member, 40, pyramid line 11, the distances between foot joints, 31, height to apex, 88, and height to peak joints, 68. The triangular openings, 2, between legs are vertically or near-vertically situated, leaning outward or inward, as chosen.

Figure 3:
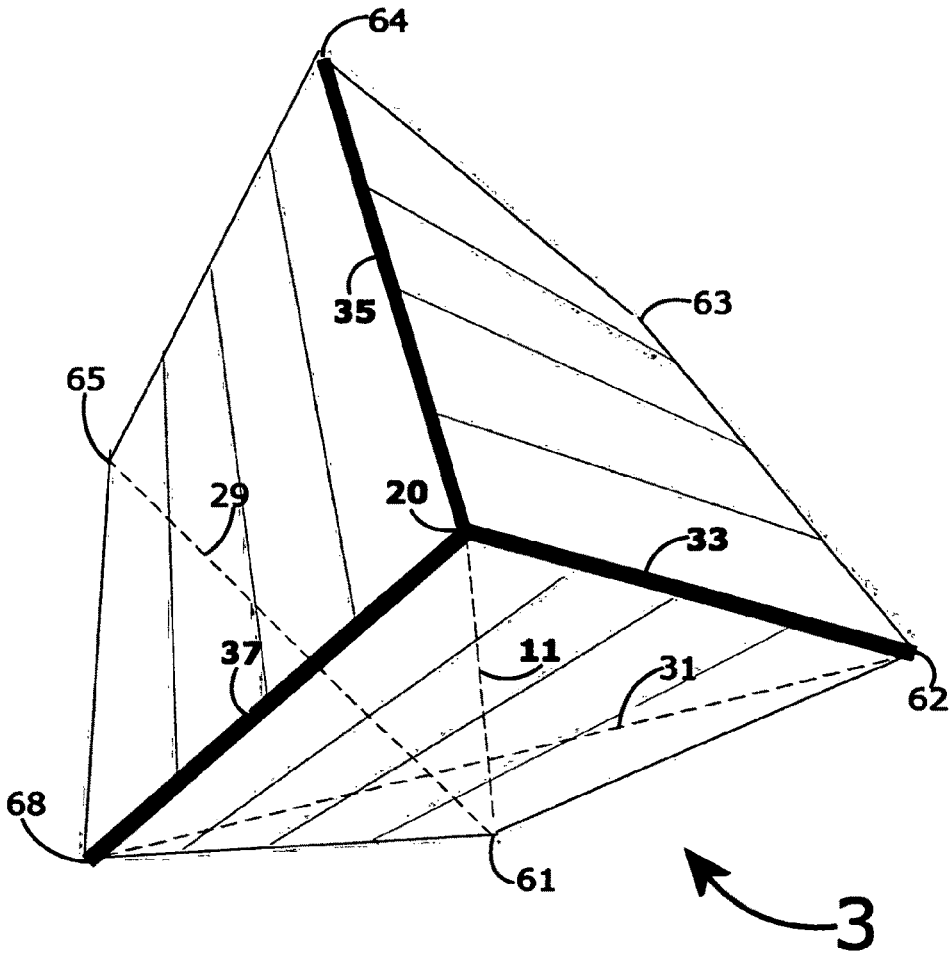
FIG. 3 is a top isometric view of a 3 way embodiment of the instant invention.
Figure 4:
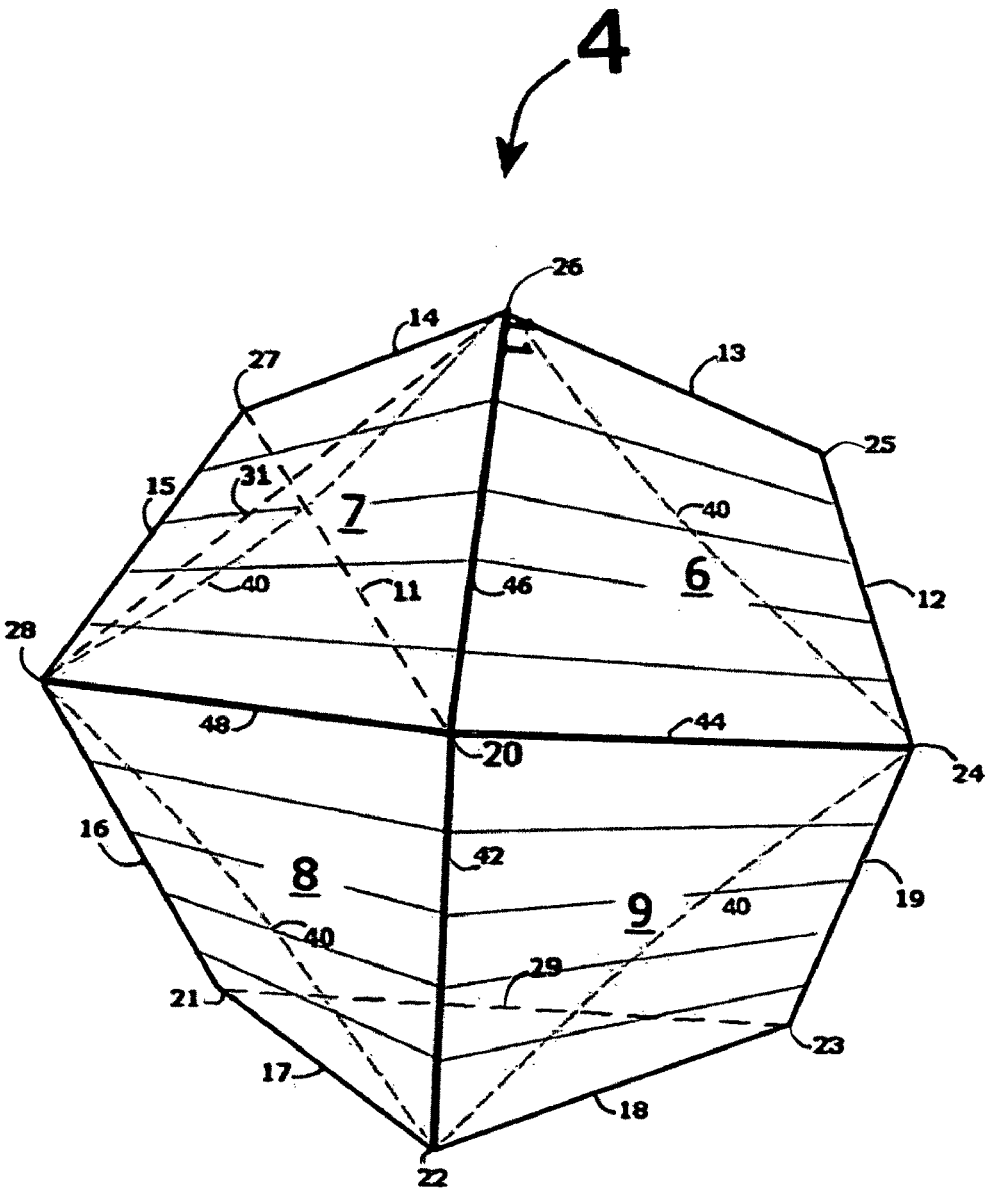
FIG. 4 is a top isometric view of a 4 way embodiment of the instant invention.
Figure 5:
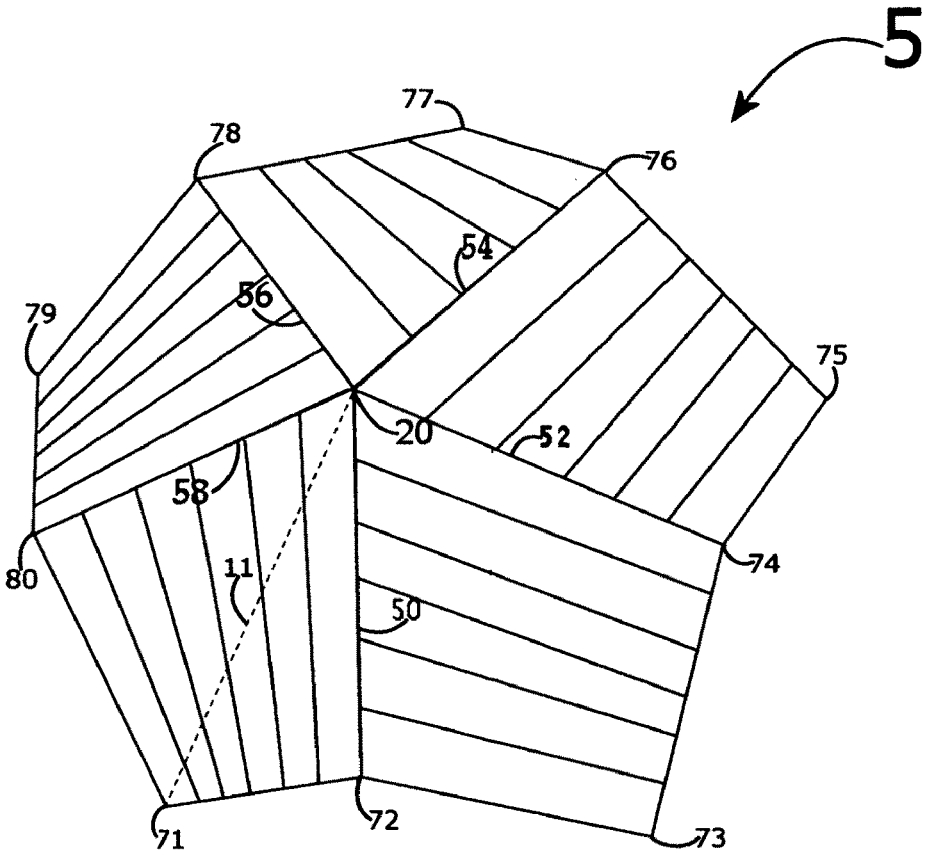
FIG. 5 is a top isometric view of a 5 way embodiment of the instant invention.

Now referring to FIG. 3, when N is equal to three, three ridge lines 33,35,37 run from the three peak joints, 62,64,66 to the apex 20, in the center of the hypershelter. And referring to FIG. 4, 4 ridge lines (ridge members) 42,44,46,48 are formed And now referring to FIG. 5, when N is equal to five, five ridge lines 50,52,54,56,58 are formed. FIG. 5 also shows two layers of in-framing, crossing each other. When N is greater than the preferred 4, the hypershelter generally covers more of the base area per height than those with N less than 4.

Now referring again to FIG. 3, FIG. 4, and FIG. 5, at the intersection of all ridge lines a central apex 20 is formed, here labeled the same in each symmetry. Pyramid lines, 11, and peak joint distances, 31, are also labeled the same in each symmetry.

Figure 7:
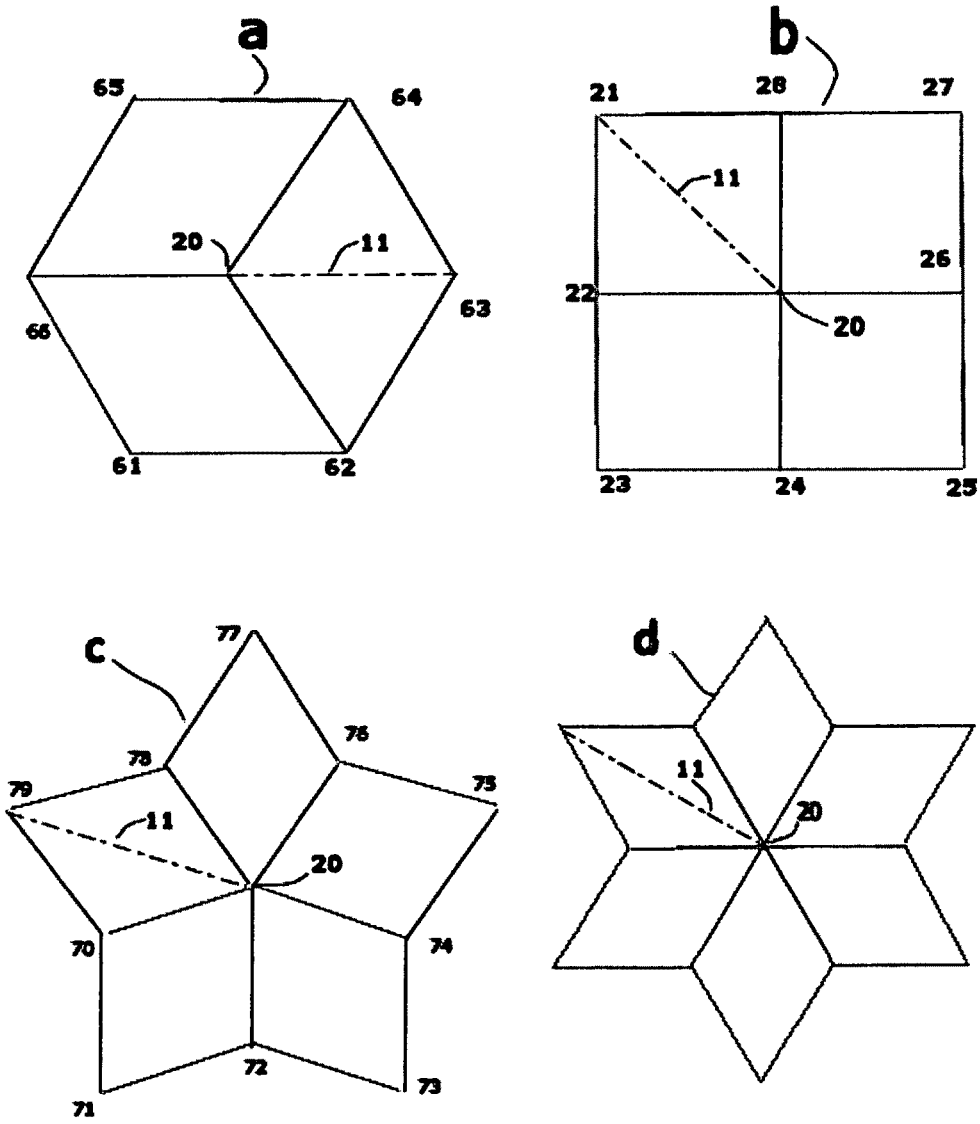
FIG. 7 is a plan view of the main framing members of each of the symmetry embodiments laid out in initial preparation for next steps in assembly.

Now referring to FIG. 7: In each symmetry, the initial layouts of leg and ridge members form patterns of flat quadrilaterals, N of which meet around a center, where the ridge members join to form an apex. In the initial layouts, FIG. 7, the leg members and the ridge members are laid out flat on the base, with the ridge members running radially from the apex, 20, and the legs surrounding them. The ends are joined using a flexible material of a type which depends on the scale. For example, for frames made of rough poles, lashing can be used, and for a small playhouse made of plastic pipe, rubber bands cut from bicycle inner tubes are sufficient. For a garage-sized building where 2×4's are being used, pieces of plumber's tape or hinges function temporarily for the erection process. In this and certain larger buildings, a more rigid fastener may be applied after erection for the sake of reinforcement. But, over-all stability does not depend solely on the strength of connectors, but on the global configuration of the structure.

Figure 6:
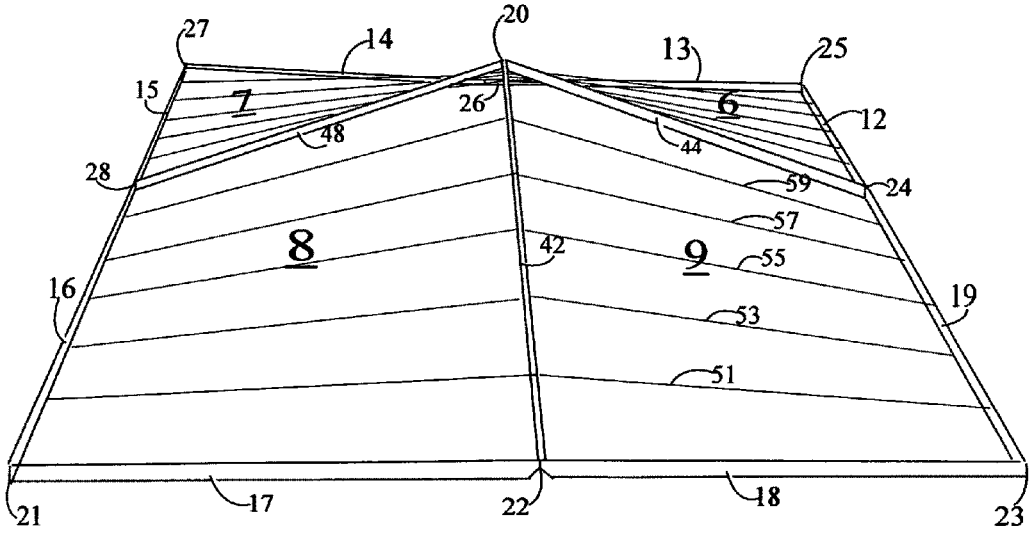
FIG. 6 is an isometric view wherein the apex is partially raised during the construction process.

Now referring to FIG. 6, the apex 20, at the center, is then lifted a prescribed amount, (in the preferred embodiment, the amount is ⅓ of the chosen length C) and supported temporarily, while the tension restraining member is installed. The "chosen length" C is used here to represent the equal length of leg and ridge members, chosen for a particular hypershelter according to its desired use. The in-framing may be attached either before or after the lifting of the apex.

Now referring again to FIG. 6, the in-framing members 51,53,55,57,59 are attached at equal intervals along the members of the under-framing, with their outer ends attached to the leg members and their inner ends attached to the ridge members. Flexible connectors are again used. All framing members taken together, underframing, 12,13,14,15,16,17, 18,19, and 42,44,46,48, and inframing, 51,53,55,57,59 and 34,36,38 comprise the framework Note: a series of in-framing members will span distances that vary, down to 97% of the chosen length, at the center of the series in the preferred embodiment, due to the nature of the hyperbolic paraboloid surface. In this example, 55 and 36 are the shortest members. An easy way to determine the proper percentage for cutting the in-framing members is to mark them while the framing is lying in place with the apex partially elevated, as in FIG. 6, although calculated examples are provided herein, for embodiments using five inframing members per face. (See Instruction manual, Step 3, below) For many applications, especially those framed in cruder materials, such as pine, fir, bamboo poles, or lengths of pipe, these variations in length can be ignored, provided there are sufficiently flexible connectors used. In such applications, the in-framing may be layered over the under-framing members, rather than abutting inside them, so that the inframing can protrude a suitable amount.

The tension restraining member, 40, is applied between peak joints and adjusted until a prescribed distance is reached. In the preferred four-way embodiment, the distance between peak joints is four-thirds the chosen length, C. The tension restraining member, connecting each of the peak joints to the two nearest, is to stabilize the assembled framework during and after construction. It is recommended that the cable be positioned under the in-framing members to avoid interference with the roofing, and to help support the area around the center of each hyperbolic paraboloid face. In the procedure wherein the under-frame is to be fully erected without the in-framing, temporary braces running congruent with or parallel to the pyramid lines, 11, may be connected, one end near the apex, and one end near the foot joint. After erection of the underframing, and after the inframing, the tension restraining member and the sheathing are in place, these temporary braces should be removed, as they intrude into the usable volume of the hypershelter.

Finally, the entire framework is raised to a given height by the application of upward force on the peak joints. The foot joints are then adjusted to previously-marked positions at the base, and the framework takes its final shape. Now referring again to FIG. 2, each flat quadrilateral (from FIG. 7) forms an a-planar quadrilateral frame after erection. For example, on the periphery of face 8, the a-planar quadrilateral frame forms between legs, 16,17, and ridge members, 42,48.

Additional layers of in-framing FIG. 1, items 34,36,38 may be added, without substantially affecting the hyperbolic paraboloid curvature achieved in the final phases. A series of short pieces may be installed diagonally between framing members, from the foot joints to the apex, to function as radial bracing, FIG. 1, items 39,41,43,45,47,49. Together, they will form the primary arch between the foot joint and the apex, providing additional load-bearing support. For the larger structures, similar bracing may be added running parallel to the main series, connecting points on the legs to points on the ridge members, where these secondary braces lean in compression against one another. Additional circumferential cables may also be attached at the lower ends of each of the braces which attach to the legs, to restrain the outward forces.

The last step is the application of covering materials FIG. 1, item 10, substantially perpendicular to the top layer of in-framing members. If near-rigid sheeting is used, it is applied in strips, each being given a slight twist to conform to the a-planarity of the framework. When completed, the covering forms N hyperbolic paraboloid surfaces.

Now referring to FIG. 3, a large volume-to-surface-area is achieved in a 3-way embodiment when the distance between foot joints equals C, and the inside angles at the peak joints are maintained at 60 degrees, so that the "pyramid edge lines", 11, the imaginary lines between the apex and the foot joints, are also maintained during erection, and are also equal to C. This results in an apex height of the square root of ⅔ C. The over-all coverage of this 3-way embodiment shelters a footprint approximately the shape of an equilateral triangle. The apex-height-to-base-area ratio is 4/9 times the square root of two over C, or about 0.6285 times $C/C^2$.

Referring again to FIG. 4, in the preferred embodiment, the length of ridge members 42,44,46,48 and the leg members, 12,13,14,15,16,17,18,19 are equal (called the "chosen length", C). The apex is raised to a height, FIG. 2 item 88, equal to the ridge or leg member length, C. The peak joints are at a height, FIG. 2 item 68 of ⅔C, when the foot joints form a square on the base plane with diagonals equal to 2C. Spacing between foot joints, 29, is the square root of 2 times C as are the pyramid lines, 11, between apex and foot joints. The apex-height-to-base-area ratio is 0.5/C. Angles between leg members, and between leg and ridge members are all 90°.

An enclosure which is spherically symmetrical can be formed with this embodiment, having a total of 12 hyperbolic paraboloid faces, on 12 a-planar quadrilaterals in a symmetry similar to that of a rhombic dodecahedron: by connecting at the foot joints two of the said preferred embodiment, four pairs of triangular openings are formed between them. Each pair forms an a-planar quadrilateral which is the same as the initial ones. When in-framing is added, the same hyperbolic paraboloid loci are thereby formed. One use for these might be as Christmas tree ornaments, with the chosen length, C, at 2 or 3 inches.

In a 5-way embodiment, FIG. 5, the pyramid line lengths can be maintained from the initial layout, where they are equal to 1.618 times C. If the apex is to be raised up so that the triangular openings are approximately vertical, the distances between foot joints are 1.36 times C, where the height to apex is 1.13C. The apex-height-to-base-area ratio is 0.3551 over C. With vertical triangular openings, the hypershelters can be fitted snugly against each other at these openings, with ten of them in a circular arrangement.

An interesting five-way might be one in which the foot joint distances are equal to the pyramid lines, or 1.618 (Known as "phi", or the golden proportion) times C. This would enable the construction of another enclosure which is spherically symmetrical, with a total of 30 hyperbolic paraboloid faces, symmetrically similar to a rhombic triacontahedron.

In a 6-way, the pyramid line lengths can be arbitrarily reduced from the initial layout in order to achieve vertical triangular openings. This will accommodate their use as modules, fitting together to form clusters.

Embodiments Varied by Repositioning the Joints

There are two separate operations which may be applied to vary the over-all shape of a hypershelter: The first is to vary the positions of the peak joints, and the second is to vary those of the foot joints. These variants can be modeled simply in the underframing, without reference to the inframing, as the inframing will follow the forms of the resulting quadrilateral frames.

Beginning with the model of any hypershelter, without varying the positions of the foot joints, the peak joints may be varied outward to the limit in which the ridge lines are parallel to the base plane. At this point, the apex height is equal to that of the peak joints. With the apex either above or below them, the peak joints may be varied inward to the limit in which they meet at the axis.

Similarly, the foot joints reach their outwardly varied limit when the legs become parallel to or lie on the base plane. With foot joints either above or below the peak joints, the foot joints may be varied inward to the limit in which they meet at the central axis.

Either operation may be applied to any given position of the other. Certain embodiments may thereby be formed which are simply mirror images, or upside-down versions of certain others.

Embodiments Derived at the Varied Foot Joint Positions

The leanings of the triangular openings and the a-planarity of the quadrilaterals also change when one adjusts the positions of the foot joints. When the foot and peak joints are varied to a certain point, the planes formed by the ridge members have slopes equal to those formed by the legs, and the quadrilaterals are simply planar. If the apex is above the peak joints, a new a-planarity forms as the foot joints are moved outward, and the ridge members slope more steeply than the legs.

Figure 8:
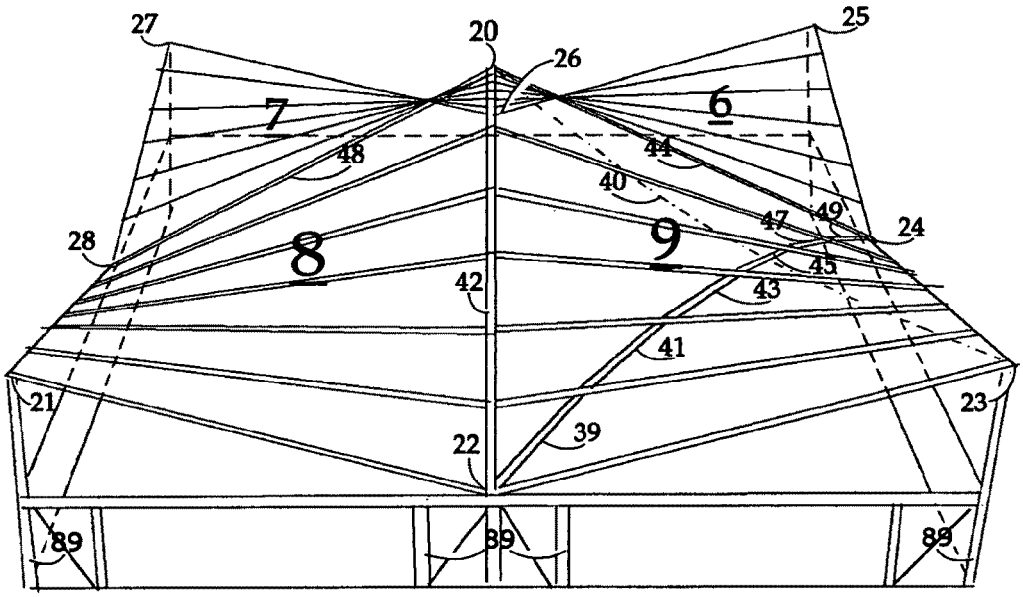
FIG. 8 is an isometric view of an embodiment of a variation referred to herein as "flying".

This results in the hyperbolic paraboloid faces having reversed curvatures, and is described herein as a "flying hypershelter" in reference to its aesthetics. A point is reached wherein the legs are horizontal. At this point there are no longer any triangular openings and the structure then appears as in FIG. 6. Variations formed by lifting the foot joints higher than the peak joints, FIG. 8, are also referred to as flying. In said flying variations, the positions of the tension restraining members 40, and the radial bracing, 39,41,43,45,47, 49, are reversed, the weight being focused primarily onto the peak joints, 22,24,26,28, rather than the foot joints, 21,23,25,27. The flying variations being primarily roof, it may be necessary to construct structures beneath them, 89, to enclose usable volume Additional cables should be attached at the peak joints, to restrain the outward forces exerted there. These can run circumferentially, or be directed through the center, connecting pairs of oppositely situated peak joints.

If instead, one moves the foot joints inward when they are below the peak joints, the triangular openings lean further outward, and the a-planarity of the quadrilaterals increases. The limit is reached when the foot joints meet at a point on the central axis, forming a configuration having no triangular openings, thus forming another variation usable in ornamental applications.

Variations in Relative Lengths of Legs and Ridge Members

Shorter legs means the triangular openings lean inward less, which may be desired for higher values of N, where one may wish to have vertical triangular openings. The shorter legs also allow more base area per height, or greater spanning capability.

In symmetries where N is even, leg members and their opposite ridge members may be varied, while remaining equal to each other, while the other two members of each a-planar quadrilateral are unchanged. This results in a set of a-planar parallelograms, and the symmetry becomes N/2 of the original.

Needs of Structure Determines Embodiment to be Used

By modifying the relationships as above one can find a hypershelter configuration to fit a wide variety of purposes.

Construction Procedures in the Preferred Embodiment

Referring again to FIG. 2, a Hypershelter is N-way symmetrical, consisting of:

- N triangles, (also called triangular openings, 2) the preferred being isosceles, erected upon a planar base, 1. Said triangles are formed between any two leg members and the base, each having one peak joint at the top, and two foot joints at the base.
- There are 2N leg members, N peak joints, and N foot joints.
- N ridge lines (ridge members) run from the peak joints to the Apex in the center of the hypershelter.
- N hyperbolic paraboloid faces are formed on the a-planar quadrilateral sections, each between two leg members and two ridge members.
- One Apex, 20, at the highest point of the structure, is located on the central axis.

There are five parameters which can be varied to achieve a desired configuration: 1) height along the axis, from apex to base, 88, 2) heights of peak joints, 68, 3) distances between foot joints, 29, 4) distances between peak joints, 31, and 5) the pyramid lines, 11.

A hypershelter may be created by the following steps: (a) generating a model of a hypershelter, (b) choosing components with which to form a hypershelter according to the model; and (c) fastening the components to each other according to the model, and raising it into place for completion.

Generating a Detailed Model:

The first step in establishing a model is to arrange the N triangles symmetrically around the axis, positioning them substantially vertically, so that each of the 2N legs is joined to the next at the base to form the N foot joints. Connected to the N peaks of these triangles (peak joints) are the N ridge members, which then join at the apex. In the preferred example, this would be: 4 triangles, formed of the 8 leg members, 12,13,14,15,16,17,18,19, each joined to the next at the base to form 4 foot joints, 21,23,25,27. Connected to the 4 peak joints, 22,24,26,28, are the 4 ridge members, 42,44,46,48, which join at the apex, 20. Together these form the outline, or the "underframing" of a hypershelter.

A variation in the form of the hypershelter may be obtained in which the leg members are unequal, the lengths of which are chosen according to the effect desired. If N is an even number, and half of the leg members are to be shorter, the ridge members opposite may also be of the same length, to maintain parallelism. However, the preferred form is that in which all leg members are equal.

The triangular openings may be arranged leaning outward, leaning inward, or vertical, depending on desired results. The outward lean of the preferred isosceles right triangles is approximately 70.5 degrees from the planar base, in which the resulting height, 68, at the peak joints is ⅔ of the leg or ridge length. In this preferred position, the ridge members, 42,44,46,48, join the leg members, 12,13,14,15,16,17,18,19, at the peak joints, 22,24,26,28 at 90 degrees to each, have lengths equal to those of the leg members, and have an angle of 70.5 degrees to the vertical axis, whereat they join each other, forming a point called herein the apex, 20. Preferred length of ridge members is equal to that of the leg members, and the height, 88, from planar base to apex is also that same length, herein referred to as the "chosen length", C.

Variations to the preferred can also be had, wherein the lengths of the ridge members are greater than or less than the leg members, depending again on results desired. Lengths so chosen will also affect the leaning angles of the triangular openings. Other variations involve the relationships of the inward or outward positioning of the foot joints or the peak joints, and whether the apex or the foot joints are above or below the peak joints. (See Variations, above).

Constructions Made by Folding Sheet Material

Another method may be used to create hypershelter structures, especially on small scales where the tension members are difficult to apply within tiny margins of error. Smaller structures, which may be used as ornaments, or as models for larger hypershelters, can be constructed by the following procedures:

Step 1: On sheet material, such as cardboard, plywood, sheet metal, or paper, draw a set of N quadrilaterals meeting at an apex in the center, as in FIG. 7. For a model of the preferred embodiment, the pattern is simply four squares, 4, and for others of equal leg and ridge members, it is N rhombuses. The 5-way appears as a five-pointed star, 5, the six-way is a six-pointed star, 6, and the three-way, 3, appears as a hexagon. The outer lines, leg members, may also be shorter or longer than the radial lines at the center (ridges), or parallelograms may be made, having unequal leg and ridge lines. For "taller" versions, the sum of all angles around the apex may be less than 360, so there will be a gap between two of the ridge lines. For "squat" versions, the sum of the angles may be more than 360, resulting in lower slopes of the ridges. For these, the last quadrilateral will appear to overlap the first on a planar lay-out, and must be added in separately.

Step 2: Cut the sheet material along the outer edges of your pattern (legs) and along the inner edges (ridges) at any gaps.

Step 3: Fold the sheeting upward along pyramid lines, 11. Fold the sheeting downward along the ridge lines (42,44, 46,48 in the 4-way). If you are using heavier material such as plywood, the folds must be done after cutting along the appropriate lines, and connecting as in step 4.

Step 4: If there are gaps, or added quadrilaterals, connect these with materials such as tape or tie plates.

Step 5: Establish the desired shape by placing the foot joints (21,23,25,27 in the preferred) at the desired positions on a base. Various embodiments may be made by choosing positions further inward or outward from the center.

Step 6: Attach inframing (51,53,55,57,59 in the preferred) between the upper folds, which represent ridges (42,44,46, 48 in the 4-way), and the cut edges, which represent legs.

The sheeting material is not meant to be part of the hypershelter, but is only used as a means to arrive at defined configurations for the underframing. It may be removed from the resulting structures.

Volumes: For any hypershelter of symmetry N, there is a variation in height-to-base-area ratios, wherein the volume-to-surface-area ratio is a maximum. The volume may be estimated by adding the volume of the inner pyramid, and the N tetrahedrons whose outer corners are the peak joints. For the preferred embodiment, the inner pyramid is formed between the base and the imaginary lines between the apex and the foot joints, (pyramid lines, 11). The faces of this pyramid are equilateral triangles, each bordered by two pyramid lines, 11, and a foot joint line, 29. Its volume is: Area of the base times height divided by 3·(?2×?2×⅓). There are 4 right tetrahedrons inside the pyramid along the axis, and there are 4 identical ones outside it, (outlined by, for example, members 17,18,42, and lines 11,11,29). sharing the above equilateral triangles. Thus the total of the tetrahedral volumes is equal to that of the pyramid, and the total volume of the under-framing, as defined above is then 4/3 times C cubed. There is an additional bit of volume between this and the hyperbolic paraboloid surfaces. A line connecting the peak joints, 31, the a-planar quadrilateral lines, (for example, 16,17, and 42,48,) and the pyramid line, 11, form the edges of a smaller tetrahedron which volume is divided in half by the hyperbolic paraboloid surface of the hypershelter. So, 4/27 times C cubed is added to the total, making the hypershelter volume equal to 40/27 times C cubed. The surface area, including that of the triangular openings, is approximately 5.975 times C squared. An additional bit of volume lies under the peak joints, between the outwardly leaning triangular openings, 2, and the base, 1 and vertical support posts which may be added along the peak joint height lines, 68. The volume of each of these extra tetrahedrons is 1/27 times C cubed, so another 4/27 is added, for a grand total of 44/27. The Vol/surface=0.3/11, or 27272727C.

The range of variations having the greatest volumes per surface area are those between a "tall" hypershelter with an apex height of twice the peak joint heights, and a "flat" one with an apex height equal to the peak joint heights, where the ridge members are horizontal. In examples using N=4, the ratio in the preferred is 0.2727C. In the "tall" embodiment, it is 0.2588C. The "flat" one is 0.24536C. It is within these ranges that the best anti-kiting effects are also obtained.

A variation may be obtained wherein the foot joints are moved outward until there are no more triangular openings. The legs are then horizontal, as in FIG. 6, or may be tilted upward by raising the foot joints, as in FIG. 8. This is one way to create what is to be referred to herein as a "flying" or "winged" hypershelter, wherein the leg members appear to fly upward from the central core, rather than downward, and the weight focuses onto the peak joints, FIG. 8, items 22,24,26, 28, which are now lower than the foot joints, 21,23,25,27. Thus, the radial bracing paths, FIG. 8, items 39,41,43,45,47, are where the tension restraining members, 40, had been in FIGS. 1, 2, and 4, and vice versa. Additional cables, however, should be used to restrain the outward force at the peak joints resulting from roof loads. In the flying version, the other variations in equality of length among the ridge and leg members may also be applied as above, yielding additional configurations.

The above describes how a set of leg members and ridge members can be chosen to be joined together to form what is herein called the under-framing of a hypershelter. This under-framing is then the substrate onto which is attached additional framing, called herein the in-framing. There are four underframe members: two leg members, and two ridge members, outlining the space between a foot joint, the two nearest peak joints, and the apex. It is these four which form the "a-planar quadrilateral frames" across which are to be fitted the in-framing, which in turn defines the curvature of the hyperbolic paraboloid faces. The number of inframing members to be attached depends on the frequency and scale of the desired hypershelter. Inframing members (for example, FIG. 1, items 51,53,55,57,59,) are attached to the underframing at equally-spaced points along one ridge member and one opposite leg member, forming a series of near-parallel framing members that together outline a substantially hyperbolic paraboloid face. Thus, the otherwise very difficult-to-achieve hyperbolic paraboloid shape is obtained when strips of sheeting or covering material FIG. 1, item 10, is applied to the above successive near-parallel inframing members.

In an example wherein the chosen length is to be, say, 12', one may wish to place the in-framing members at a distance of 2' apart from each other, and from the underframing members, making six equal separations. Thus, in the following example, there will be five equally-spaced points placed along one leg member, and one opposite ridge member, to which the inframing is to be attached.

Instructions for Assembling an Example of the Preferred Embodiment

STEP 1 Lay out the positions where the foot-joints will be in the finished structure. The four points on the ground are at a distance of the square root of 2 times the chosen length (strut length) apart. (For a chosen length of 12, the feet are about 17' apart, and the diagonals are 24'.) The diagonals will be exactly twice the chosen length, and you can verify squareness by making sure the diagonals are equal.

STEP 2: Under-framing: A: Arrange the under-framing members in a square pattern, FIG. 4, item 4, on your site laid out in step 1, with the ridge members meeting in the middle, and the leg members forming the outline of a square around them. (If you plan to set the hypershelter on a pre-constructed floor, the foot joints will extend past the floor at this stage. Construct slide-ramps for these.)

B: Connect the members at their ends with the flexible materials, such as plumber's tape, tie plates, etc.

C: Raise the central Apex above the ground to a height of ⅓ the chosen length, FIG. 6 and support it temporarily.

STEP 3: In-framing: A: Label your inframing struts "a", "b", "c", "d" and "e" using the following table for their lengths in cases where there are to be five inframing members for each face:

| | | Referring to FIG. 6: |
|---|---|---|
| | ridge = 1 | 42 |
| | a = .9844 | 51 |
| | b = . .9750 | 53 |
| middle strut | c = .9718 | 55 |
| | d = .9750 | 57 |
| | e = . .9844 | 59 |
| | leg = 1 | 19 |

B: Connect them at equal distances apart with flexible connectors. At this stage, the in-framing members are a bit shorter than the space within the under-framing, so you may need to bend four of the leg members inward, securing them with rope while the attachments are being made.

STEP 4: Attach tension restraining member, FIG. 6, item 40 between peak joints: A: An eye-bolt is secured through a drilled hole at the end of each ridge member. The cable (galvanized, stainless steel, rope, string, or wire, according to scale) runs through each of them, passing underneath the in-framing, running all the way around, and is attached to itself using cable clamps.

B: Measure and correct the distances between peak joints, 31. Recommended distance is 4/3 the chosen length, (For chosen length 12, this will be 16'. Note that this is less than the distances were before the apex was raised up, in step 2-C)

C: Clamp the cable at each joint to prevent slippage. This step is crucial if the framing is to be raised without deformation and possible mishap.

STEP 5: Raising the Framework: A: With one person stationed at each peak joint, 22,24,26,28, hands on each of the leg members before them, on a command, raise the structure upward. There may be a pause between hip and shoulder height to reposition your hands underneath the frame, after which you proceed on upward, raising it all the way up overhead. While it is going up, the feet are moving inward, so first be sure there are no obstructions. B: The feet, 21,23,25,27, are then adjusted to the pre-marked points on the ground. (see STEP 1) C. Short pieces (32.2" for chosen length 12) are now nailed in diagonally between framing members, to function as radial bracing, FIG. 1, items 39,41,43,45,47. Together, they will form an arch between the foot joint and the apex.

STEP 6: Covering, FIG. 1, item 10. Starting along the leg member of one face, position a sheet of the pre-cut covering material perpendicular to the in-framing The top edge of the sheet should reach the ridge member, and the bottom edge should extend past the leg a few inches. Self-tapping screws with rubber gaskets are recommended, to be driven through the high parts of the ribbing and into the framing, about 24" apart. Apply one or two sheets per face before completing any one face. Then, you can lean a ladder against a face to reach the higher areas. The top edges will be covered with a ridge-cap on two ridges, while the sheets will overlap each other on the other two ridges.

General Construction Descriptions

Erection Method 1: Raising the Structure at the Peak Joints.

The assembled framework can be erected in a one-operation procedure, once the tension restraining members, 40 are attached. For small to medium-sized structures, if four workers are available, one is stationed at each of the four peak joints, FIG. 6, items 22,24,26,28, and together, they all lift the entire structure into its desired shape. The peak-joints are raised, while the foot joints, 21,23,25,27, move inward. The workers then move the foot joints to adjust the positions of these onto four predetermined support points. (In a four-way, the preferred distance between base-joints is the square root of two times the chosen length.) For small to medium applications, cement pier-blocks, with steel ties are sufficient as supports at the foot joints. It is also possible for one person to erect the framework alone, by lifting the frame at the peak joints, one at a time, and adjusting the foot joint positions as necessary. With two workers, lift two opposing peak joints, then lift the remaining two. For a very large hypershelter a crane may be employed in a fashion similar to that of four hand-laborers.

Erection Method 2: Moving the Foot Joints Inward by Means of Cables.

The second umbrella-like erection method requires that a second, lower cable be attached through slideable attachments, such as pulleys, at the foot joints, 21,23,25,27. The end of the cable is attached at one foot joint, passed through each of the others, and returns to the same foot joint and into a tool capable of exerting great tension, such as a winch. After the tension restraining member is firmly in place, lift and temporarily support each of the peak joints at a convenient height above ground level, to create a non-zero slope for the faces. Then, tighten said lower cable gradually, pulling the foot joints inward to their appropriate locations. This procedure may also be done without pulleys, using N cables connecting each pair of foot joints, and N winches, and tightening each in turn progressively. After the foot joints are securely mounted on their support blocks (or floor positions, etc) the lower cable(s) can be released, and removed.

Erection Method 3: Tilting Up of Tetrahedral Sections.

For the larger hypershelters, or when working in a confined space, it may be advisable to take a more step-wise approach: First, three or more structural members are assembled by laying out two legs and a ridge member for each, (for example, FIG. 2, items 17,18, and 42) and attaching them flexibly at their ends. This attachment point will become the peak joint, 22. The members are then lifted at this peak, until it becomes a tripod and stands at the prescribed height. (For the preferred configuration of a four-way, this will be at a position where the distances between the bottom ends of these members will be the square root of two times the chosen length, forming three right angles at the peak.) Temporary members are attached horizontally near the bottom ends, connecting each leg with the ridge member, and the legs to each other. Together with the members of the tripod, 17,18, and 42, these create a tetrahedron, which has omni-directional rigidity. Each tetrahedron is then tilted up, balancing on the two legs, 17,18, with its ridge member, 42, raised at the top. What was the bottom end of a member in the tripod, 42 now comes to a position where it will join the other ridge members at the apex, 20, of the whole structure. The tetrahedrons should be erected in positions on the ground such that, when tilted up, the ridge members come into contact with each other at the apex. If cables and winches are used in this procedure, it is advisable that there be prevention cables running in the opposing direction to prevent over-tilting. After the three or more ridge members are joined at the apex, (which, in the preferred four-way, is one chosen length in height, 88), what is now standing is a complete set of underframing, plus the temporary support members. The tension restraining member, 40, is then attached. If it is not stretched tight, there will be enough slack to take up the displacement imposed when the inframing members, 51,53,55,57,59, and 34,36,38, are added. For large structures, these may be put in place one at a time, and firmly and permanently attached to the underframe.

The sheeting FIG. 1, item 10, is finally added, and the exact procedure depends, again, on the type of material chosen. A skin of soft, flexible material such as fabric, though it will not contribute strength to the structure, may be used for its lightness, provided a sufficiently strong tension restraining member is used to insure over-all rigidity of the framework. For plywood, on smaller scales, it is advisable to first cut the 4×8 foot sheets into narrower strips, for ease of bending. This would not be necessary on a scale in which the leg lengths are 24 feet or more, because each sheet would then curve across a smaller portion of the arc. In this instance, each sheet would take up ⅓ of the curvature between leg and ridge. If sheet metal is to be applied, the typical sheet metal roofing comes in narrow strips, which are easier to conform to the in-framing. It is by this piece-by-piece assembly of the roofing conforming to the framing that the desired hyperbolic paraboloid shape is achieved. A structure with twelve-foot legs can effectively be covered with 12'×2' sheet metal, and so forth. There will be some trimming of the ends to match the angles, because, even in a four-way hypershelter they are not all 90 degrees.

It may be advisable to attach the uppermost sheets first, as a ladder may need to protrude between the framing during construction, and one would not want to block access. Screws or nails can be used in the sheeting attachment. When complete, such rigidity is achieved that, in an experiment, a prototype using 10' chosen lengths framed in 2"×2"s on 2½ foot centers, and covered in light sheet metal, supported the whole weight of a workman on the top, fastening the ridge caps. This prototype then endured a windstorm with 65 mph gusts, having no part of it tied down or anchored to footings, and suffered no damages.

Specifications

Additional Methods of Assembly and Erection

The methods claimed in patent '584 for the assembly and erection of Hypershelters are done by constructing and erecting a framework first, then applying the roof and interior sheeting. However, the assembly may also be completed with the sheeting applied at various earlier phases.

Figure 11:
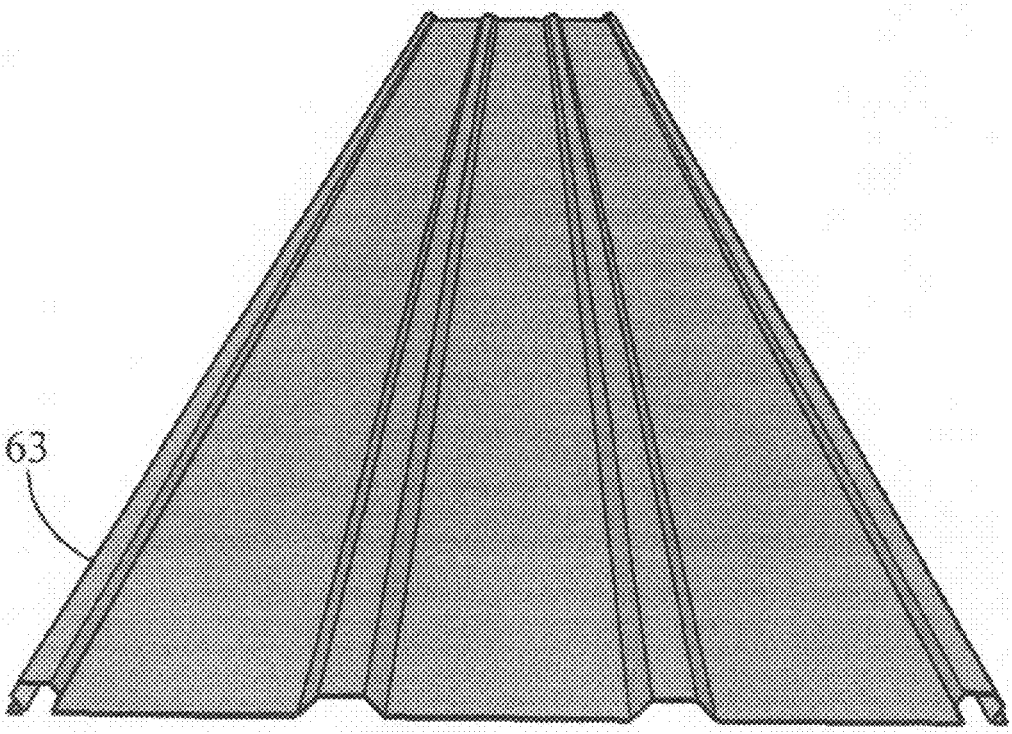
FIG. 11 is a perspective view of sheeting material with slidable connections at the edges.

Now referring to FIG. 11, with the use of special sheeting, in which the edges are joined by slidable connections 63, the faces or the entire structure may be raised along with the sheeting, while the edges slide past each other in the amount needed to conform to the a-planarity being established.

Figure 12:
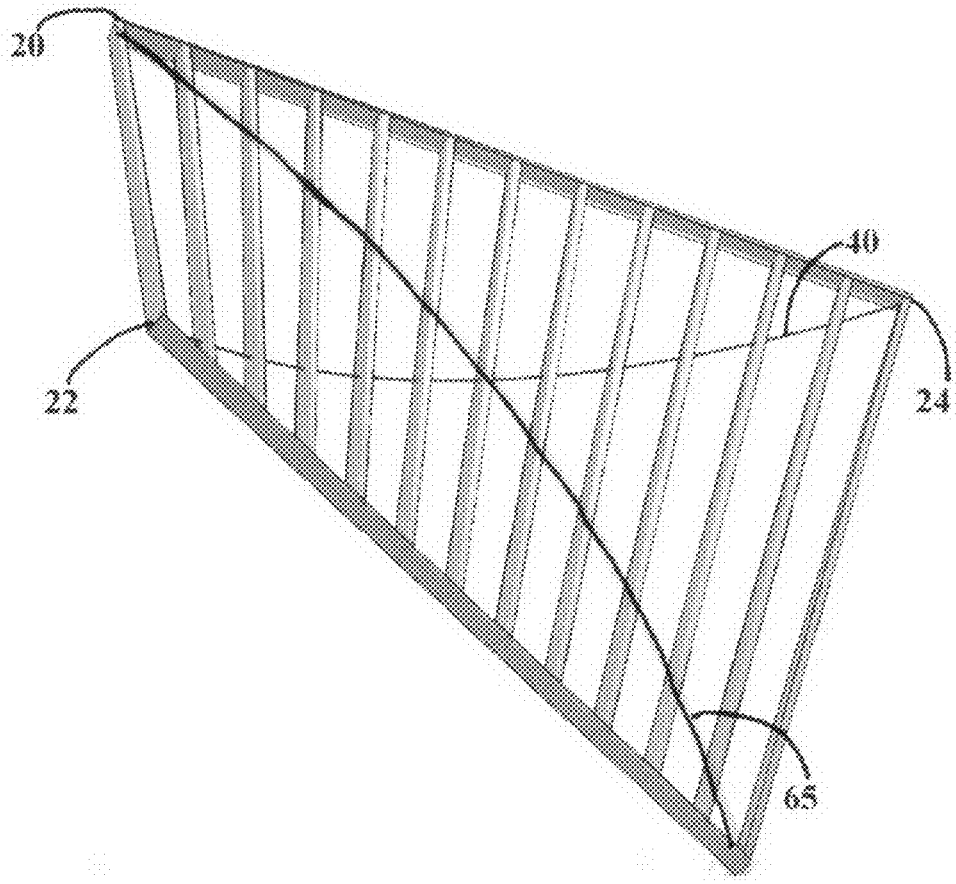
FIG. 12 is a perspective view of the framework of a face, made with twisted members.

Now referring to FIG. 1, one may also use no in-framing 53,55,57,59 at all, relying on built-in ribs of, for example, metal sheeting, and the stiffness inherent in the compound curvature of the hyperbolic paraboloid faces, and, if necessary, continuous radial bracing members FIG. 12: 65 for rigidity.

Assembling the A-Planar Faces Separately Before Erection

Now referring to FIG. 1, the a-planar faces 6,7,8,9 may each be assembled separately, rigidly sheeted, and then attached to one another during erection processes, as follow:

One way to do this is to attach two leg 18,19, and two ridge members, 42,44 in simple planar quadrilateral form on the floor or ground, then raise up two opposite joints to establish the a-planarity for a face. One joint only 20 may be raised, if care is taken to maintain the axial symmetry. Raise it to a height in the preferred of ⅓ of the chosen length, and place it on a temporary support. To ensure proper proportionality, it is recommended that the distances between opposite joints be established in this step. In the preferred, the distance between the peak joints, 22, 24, will be 4/3 times the chosen length, and that between apex 20, and foot joints 23 will be the square root of 2 times chosen. Which of the opposite joints are raised depends upon whether one will be 1) applying interior sheeting in this stage of the operation, or 2) simply sheeting what is to be the top side in the final configuration. If the interior is to be sheeted in this step, raise up the foot joint connection 23 and/or the apex connection 20, and attach inframing. The interior sheeting will be applied on the side facing up, then the assembly will be turned over, as described below. To sheet only the roof side, raise and support one or both of the other two joints, 22, and 24, (peak joints) before attaching the inframing, the cable, the bracing, the utility lines, and, finally, the roof sheeting.

The second method is to assemble (and twist, if desired) the four underframing members 18,19,42,44 on supports, such that the a-planar configuration is immediately established to its final specifications, rather than creating the a-planarity and the twisting of members during the raising of opposite joints, as above. Inframing 51,53,55,57,59 is then applied and twisted similarly.

Now referring to FIG. 12, if twistable framing materials are used in this process, most applicable when the framing members are substantially rectangular in cross-section, the underframing members 18,19,42,44 may be connected to each other without determining or cutting special angles. The end angles of all of the framing members will simply be 90 degrees, and the appropriate twist is applied to the members as the a-planarity is established. Then, the inframing members, 51,53,55,57,59 are firmly attached (either with the twisting, or with the ends cut at the prescribed angles). Each inframe member is placed at equal distances from the two neighboring members, keeping them in the proper order. Sheeitng will conform to the a-plarity formed on the twisted members' outer surfaces.

Now referring to FIG. 12, the tension restraining cable 40 of the prescribed length is then attached connecting the two peak joints, 22, 24, with the addition of a means of connecting cables in subsequent faces to each other, such as an extra length of said cable-extending beyond the connector. An additional, temporary cable may also be attached connecting the apex, 20 and the foot joint, 23, for the purpose of maintaining rigidity during subsequent construction. These cables would both typically be positioned on the underside of the framework, so they will not interfere with the application of the sheeting. However, for some applications, it will be advantageous to insert the cable 40 through a series of holes made, one in each inframe member, at prescribed intervals, such that the cable describes a continuous arc between peak joints. This way it is interfering with neither the interior, nor the exterior sheeting.

Now referring to FIG. 1, radial bracing 39,41,43,45,47,49, if required, is attached at this stage. It is to be of a material capable of supporting compression loads longitudinally. The radial bracing connects to the underframing at its ends, one at the apex, and one at the foot joint, and to points on each of the inframing members, forming the most direct route possible between the two ends. Now referring to FIG. 12, for continuous radial bracing 65 one method is to use bendable material of suitable length to run continuously from the foot joint to the apex, attaching it to each of the inframing members it crosses. Before full completion, the hyperbolic paraboloid faces 6,7, 8,9 may have utility features such as plumbing, electrical and telephone lines installed in them, with the appropriate connectors exposed or otherwise made available outside of the sheeting.

Now referring to FIG. 1, roof sheeting 10 is then firmly attached to the frameworks, each strip of sheeting being given a slight twist to conform to the framework. If the framing members have the twists, FIG. 12 the sheeting will fit flat to it at every point.

Two of the above assembled faces, for example 6 & 7, are then attached to each other along their ridge lines 46, with the apex joints 20 meeting to form one joint. This joint is raised and placed on a temporary support. One of the foot joints 25 may be flexibly attached to an anchor point on the ground or a floor or foundation at this stage. The next face 8 is then attached at the ridge 48, and the structure is raised more. Faces 8, & 9, are successively raised and attached at ridges 42 and the structure is progressively raised until the final attachment 44 remains. At this stage, the foot joints 21,23,27 are placed in their prescribed positions, or on designated supports, and the final attachment at the ridge 44 is completed. Alternatively, the faces may be raised up to their full final heights, and assembled in place. Ridge caps are then installed, as are other optional finishing parts, such as gutters.

Now referring to FIG. 5, the faces may be assembled in successively rotated directions, here showing each rotation at 72°. In the preferred, in which N=4, each face will be situated at a 90 degree rotation to the next, with its inframing substantially perpendicular to that of its neighbors, rather than substantially parallel, as described in '584. In general, for hypershelters of N faces, the rotation will be 360°/N. One purpose for this is to supply additional structural strength. Also, in this way the uppermost strip of roof sheeting may be lapped over the top of the ridge, to cover the top edge of the adjoining face, thus eliminating the need for ridge caps.

Other methods of erecting the completed faces may also be employed, such as flexibly attaching all the peak joints to each other, and raising the entire assembly by means of attachments at the joints. In the preferred, four such faces are assembled. For N-way hypershelters, N faces are prepared and assembled. The exception is with multi hypershelters, FIG. 9, in which there are 2N lower faces, plus N upper faces.

Figure 9:
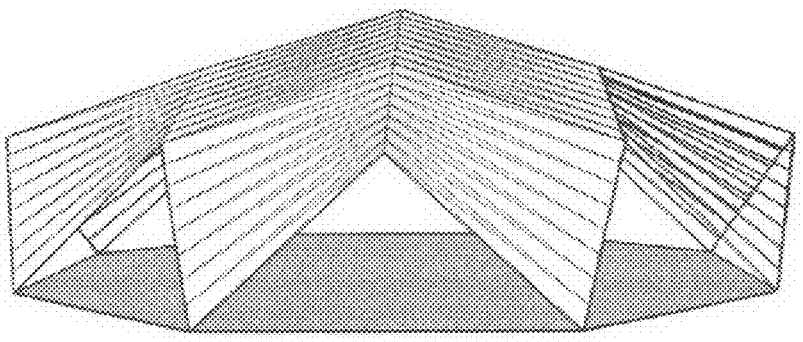
FIG. 9 is a perspective view of a "multi-hypershelter" embodiment.

Now referring to FIG. 9, the above methods make more feasible the construction of additional embodiments, wherein only half of the ridge members are attached to each other. In the "multi hypershelters", FIG. 9, the overall structure is composed of pairs of the faces, joined at their ridges, and opened outward at the opposite peak joints, leaving an upper level to be completed by a very low, or "squashed" version of a hypershelter, or simply filled in with triangular faces.

Figure 10:
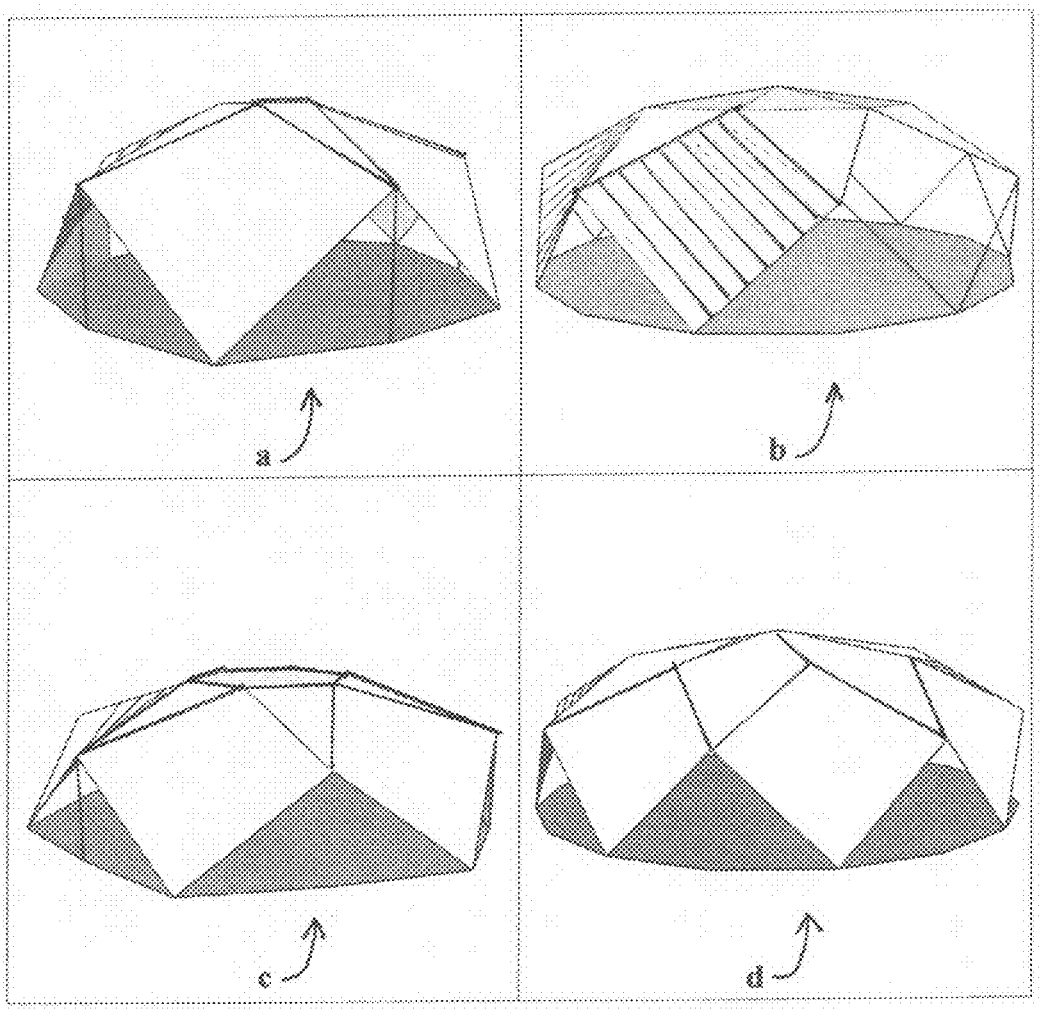
FIG. 10 are perspective views of "domular" embodiments.

Now referring to FIG. 10, in the embodiments described as "domular", rather than attach the faces to each other at points along the ridges, only the peak joints are attached to each other. There will be N apex joints, which are then to be connected by additional framing, the resulting triangles sheeted, and the N-sided polygon at the top similarly completed. Hyperbolic paraboloid faces may also be used here.

Other Embodiments Possible

While several embodiments of the present invention have been shown and described, it will be apparent to those skilled in the art that many changes and modifications may be made without departing from the invention in its broader aspects.

The invention claimed is:

1. A method for the construction of a structure comprising a multiplicity of joined hyperbolic paraboloid faces, each formed on an a-planar quadrilateral frame, each of said frames comprising an underframing which is completed by inframing to compose said frames which are covered with strips of slightly twisted sheeting material, raised into position and joined, being a method of constructing enclosures of N-way symmetry comprising N hyperbolic paraboloid faces, said structures being formed by the following process:

attaching two leg members and two ridge members in a simple planar quadrilateral underframe having two opposite joints as peak joints, and two remaining joints, one being the apex, and the other the foot joint;

raising any of said apex, foot, or peak joints a prescribed amount, twisting said leg and ridge members, thereby creating an a-planar quadrilateral underframe;

twisting and attaching a multiplicity of inframing members of substantially straight materials to the leg and ridge members, said members arranged substantially parallel to one another and to a leg and ridge member at substantially equal intervals to the other leg and ridge members, said inframing members each being twisted an amount sufficient to correspond to the a-planarity of the underframing, together forming an assembled frame composed of the a-planar quadrilateral underframe together with twisted inframing;

attaching a tension restraining member connecting the peak joints, and establishing said peak joints at prescribed distances;

twisting and attaching a covering of strips of sheeting material, oriented substantially perpendicular to said inframing, to said a-planar quadrilateral assembled frame, forming a hyperbolic paraboloid face;

erecting N hyperobolic paraboloid faces, said erecting including:

raising each entire face to a desired height, and attaching each of the faces to the next face;

attaching said tension restraining members of each face to each other at each of said peak joints;

wherein N framed and sheeted hyperbolic paraboloid faces are mutually attached, composing a completed roof structure suitable for full enclosure by enclosing triangular openings formed under the erected leg members.

* * * * *